United States Patent [19]

Alonso et al.

[11] Patent Number: 5,029,708

[45] Date of Patent: Jul. 9, 1991

[54] FRESH POTTED PLANT SHIPPING AND DISPLAY CARTON

[75] Inventors: Joseph A. Alonso, Miami; Steven Cohen, Cooper City, both of Fla.

[73] Assignee: Nekoosa Packaging Corporation, Maumee, Ohio

[21] Appl. No.: 549,087

[22] Filed: Jul. 6, 1990

[51] Int. Cl.[5] ..... B65D 85/52

[52] U.S. Cl. ..... 206/423; 47/39; 47/84; 211/73; 229/131.1; 229/169; 248/174

[58] Field of Search ..... 229/131.1, 169; 47/84, 47/39, 41.11; 206/423, 45.14; 211/72, 73, 132; 248/174

[56] References Cited

U.S. PATENT DOCUMENTS

| | | | |
|---|---|---|---|
| 1,469,536 | 10/1923 | Risley . | |
| 1,606,523 | 11/1926 | Gardner . | |
| 1,954,006 | 4/1934 | Wolf | 206/423 X |
| 3,021,046 | 2/1962 | Pullen . | |
| 3,035,751 | 5/1962 | Brown . | |
| 3,342,329 | 9/1967 | Knight . | |
| 3,521,741 | 7/1970 | Beaudry | 206/45.14 |
| 3,606,004 | 9/1971 | Fruehwirth . | |
| 3,754,642 | 8/1973 | Stidolph . | |
| 3,924,354 | 12/1975 | Gregoire | 206/423 X |
| 4,069,917 | 1/1978 | Stollberg et al. . | |
| 4,113,093 | 9/1978 | Hendrickx . | |
| 4,209,092 | 6/1980 | Jones | 206/423 |
| 4,726,468 | 2/1988 | Hesser et al. | 206/423 |

FOREIGN PATENT DOCUMENTS

| | | | |
|---|---|---|---|
| 1469650 | 2/1967 | France | 47/84 |
| 891078 | 3/1962 | United Kingdom | 47/84 |
| 2162497 | 2/1986 | United Kingdom | 206/423 |

*Primary Examiner*—Bryon P. Gehman
*Attorney, Agent, or Firm*—Thomas A. Meehan

[57] ABSTRACT

A square RSC carton for potted plants and flowers to be used for shipping the potted item in the carton to the retail store, and for display of the potted item at the retail store. The top flaps are perforated for removal of arcuate portions of the top flaps and form a circular rim defining an aperture through which the flower pot is placed for support of its flange on the top flaps at the circular rim. "Pop-in" segments are formed across the corners of the adjacent side panels by parallel lateral slits and parallel vertical hinges enabling reversing the structure to support the weight of the flower pot by the top flaps. The top flaps are also infolded at second fold lines to suspend the flower pot below the top end of the carton thereby hiding the pot inside the display and showing only the flowers or plant.

13 Claims, 2 Drawing Sheets

FRESH POTTED PLANT SHIPPING AND DISPLAY CARTON

The present invention relates to a corrugated paperboard carton for shipping and displaying fresh flowers and plants that are potted. More particularly, the present invention relates to such a carton which is formed from a one-piece blank of corrugated paperboard and which may be used to display the plant to the consumer.

BACKGROUND OF THE INVENTION

There exists a need to not only package plants and flowers that are in pots to ship them to the marketplace, but also to attractively display the product at the retail environment.

Typically, potted plants are handled either in bulk form or are placed in a shipping carton and transported or shipped to market. The shipping carton needs to retain the pot or potted plant in a position within the carton, and for such purpose, various cartons are devised with partitions or holding elements adhesively secured or stapled into the sides or panels of the box, which are folded to a position to restrain and retain the flower pot. A typical example of such a carton is disclosed in U.S. Pat. No. 1,469,536 and in U.S. Pat. No. 3,342,329. Other containers exist for shipment of perishable cut flowers and plants that may be used for displaying same for sale at their destination. Examples of such a container are disclosed in U.S. Pat. Nos. 3,754,642 and 4,113,093.

SUMMARY OF THE INVENTION

The present invention provides a one-piece carton of corrugated paperboard which contains a potted flower or plant for shipment to the marketplace and which is convertible at the retail market to display the potted flower or plant, as on a pedestal, yet conceal the flower pot within the display so as to be virtually unseen by the retail customer and display only the attractive flowers or plant.

The carton blank is formed as a blank for a square RSC container having equal size side panels and top and bottom end flaps. The top end flaps each have scored, double reverse parallel fold lines, one fold line hingedly connecting the flap to the side panel for folding the flap inwardly next to the side panel and the second fold line for folding a portion of the flap to extend across the end of the container. The four top end flaps overlap each other and provide a recessed end closure across the top end of the carton substantially closing it. The top end flaps also include perforated semicircular scores for providing a center hole in the top end of the carton for supporting a potted plant thereby. A first slit is cut in the side panels across the fold line of adjacent panels at the point where the second fold line of the top end flaps reverse fold the flaps. A second parallel slit is cut in the panels below the first slit, and the first and second slits provide a pop in support member in the side panel for the in-fold top flaps.

The carton is used for shipment of the potted plant with the top flaps closed, and at the point of display the plant is removed. There the top end flaps have their perforated semicircular portions removed and the top end flaps reclosed which provides a recessed ring-like support for the pot on display. The recess of the top end flaps below the top edge of the container place the potted flower on a pedestal display with the pot supported below the top edge of the container and not in the sight of the customer.

The carton blank may also be provided with hand hole cutouts in one or more of the side panels, preferably near the top end of the carton, for ease in lifting and handling the carton in transport or during display of the potted flower or plant.

Thus, the present invention provides a carton to display potted plants and flowers o substantial weight that will suitably support the flower pot such that it will not be seen with the display, thereby only showing the attractive flowers and foliage of the plant.

And, equally as significant, the carton is strong enough to withstand extreme shipping conditions of vibration, compression from stacking and humidity. The carton also includes a waterproof lining or coating in the area surrounding the bottom end and on the bottom flaps in the event moisture or water from the plant is leaked during shipping, thereby preserving the strength of the paperboard.

Other features, advantages and aspects of the invention shall become apparent to those skilled in the art upon reference to the accompanying drawings and the description of a preferred embodiment hereinafter set forth.

DETAILED DESCRIPTION OF THE INVENTION

Figure 1:
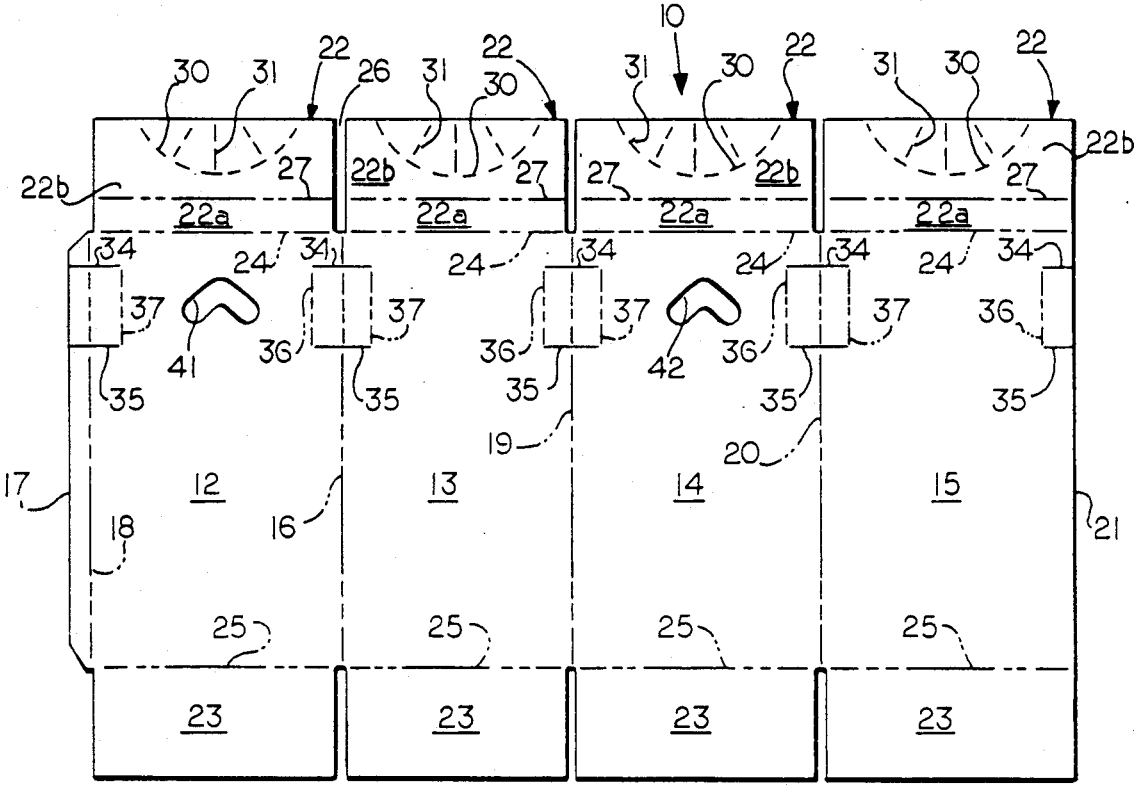
FIG. 1 is a plan view of a one-piece blank from which the carton of the invention is constructed.

With reference to FIG. 1, a one-piece blank 10 for the carton 11 (FIG. 3) is illustrated. Blank 10 includes four equal width side panels 12–15, inclusive. Side panel 12 is hingedly connected to panel 13 along a fold line 16 on one side and a flap 17 for making a manufacturer's joint is hinged at fold line 18. Side panel 13 and 14 are hinged at fold line 19 and panel 14 and 15 are hinged at fold line 20. The free edge 21 is placed adjacent fold line 18 at the opposite end of blank 10 and flap 17 is glued, stapled or otherwise fastened in known fashion to form blank 10 into a square tube. The fold lines are formed by crushing the paperboard along a line for the hinge.

As an operable exchange of the container for the present invention, the side panels 12–15 are each 13×22 inches which will provide a container that is 13×13×22 inches. The blank 10 shown on FIG. 1 has top and bottom flaps 22 and 23 which are slotted at 26 as in a square RSC (regular slotted container) blank. The top and bottom flaps 22 and 23 are approximately of the same dimension extending from their outer edge to the respective first fold lines 24 and 25 connecting the flaps to the side 12–15.

Figure 2:
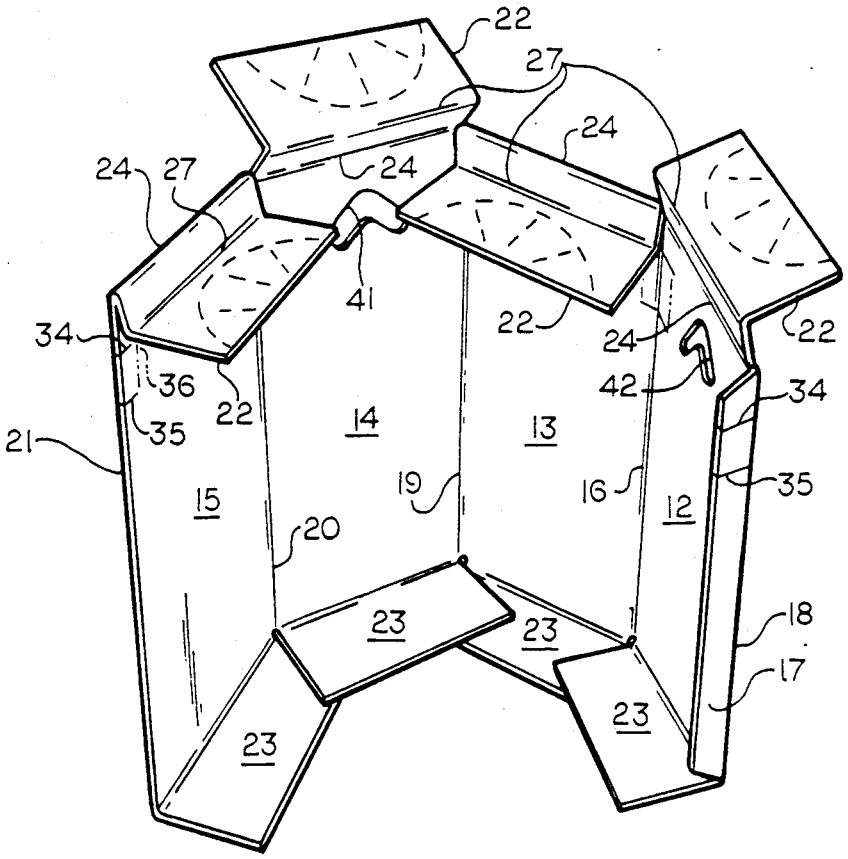
FIG. 2 is a perspective view of the blank of FIG. 1 folded and undergoing construction of the carton.

The blank is folded into assembly, as is indicated on FIG. 2, and the glue flap 17 is secured to the side panel 15 adjacent the free edge 20. Top flaps 22 also have a second fold line 27 spaced from first fold line 24 and parallel thereto. In the assembly, bottom flaps 23 are folded inwardly along their fold lines 25 and form the bottom end closure of the carton 12 in a usual manner. Top flaps 22 are also folded inwardly along their first fold line 24 such that the near portion 22a of the flap lies adjacent to the side panel, such as 15 shown on FIG. 2, and the outboard portion 22b of the flap 22 is folded upwardly along second fold line 27 to extend perpendicular to the first portion 22a.

Figure 3:
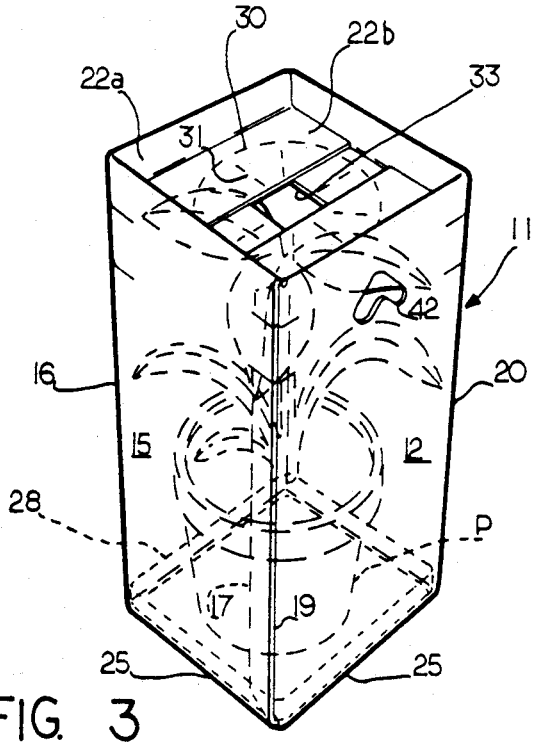
FIG. 3 is a perspective view of the erected carton containing a potted plant for shipment.

Prior to folding top flaps 22, as was just described, the potted plant P is inserted into the carton in a position shown on FIG. 3. A waterproof bottom liner 28 may be provided to prevent moisture or water leaving the pot of potted plant P from wetting the corrugated paper. Liner 28 may be in the form of a tray of plastic material, such as molded polystyrene, or may be in the form of a waterproof coating applied on the inner linerboard of the corrugated paper. Wax coatings are typically used for this purpose. For the sake of cost, the coating may be applied on the blank 10 over the inner surface of the bottom flaps 23 and a marginal portion at the lower end of the inside surface of the side panels 12–15.

Each of the top flaps 22 also includes an arcuate perforate score line 30 and a series of radial perforate score lines 31 extending from the free edge of the flap to the arcuate score line 30. The perforated scores are ½ inch by ½ inch perforated scores or knife cuts through the paperboard. This pattern of perforate scores allows the user to readily remove the portion of the flap defined by the arcuate line 30, the four top flaps with the area of paperboard removed within the arcuate line 30 combine to define a circle defining a rim edge 32 (see FIG. 4). With the flaps 22 folded such that their laterally extending portions 22b overlap and the circular cutout (perforated) area removed, the remaining overlap of the paperboard of the top flaps 22 provides the circular rim edge 32. The laterally extending portion 22b of flaps 22 is less than half the width dimension of the equal side panels. In the original folding of flaps 22 before the circular area of the paperboard material is removed, as is shown on FIG. 3, the reverse fold of the flaps at fold line 27 forms a square aperture 33 at the top of the carton as an air vent for the plant that is contained within the carton 12.

Figure 4:
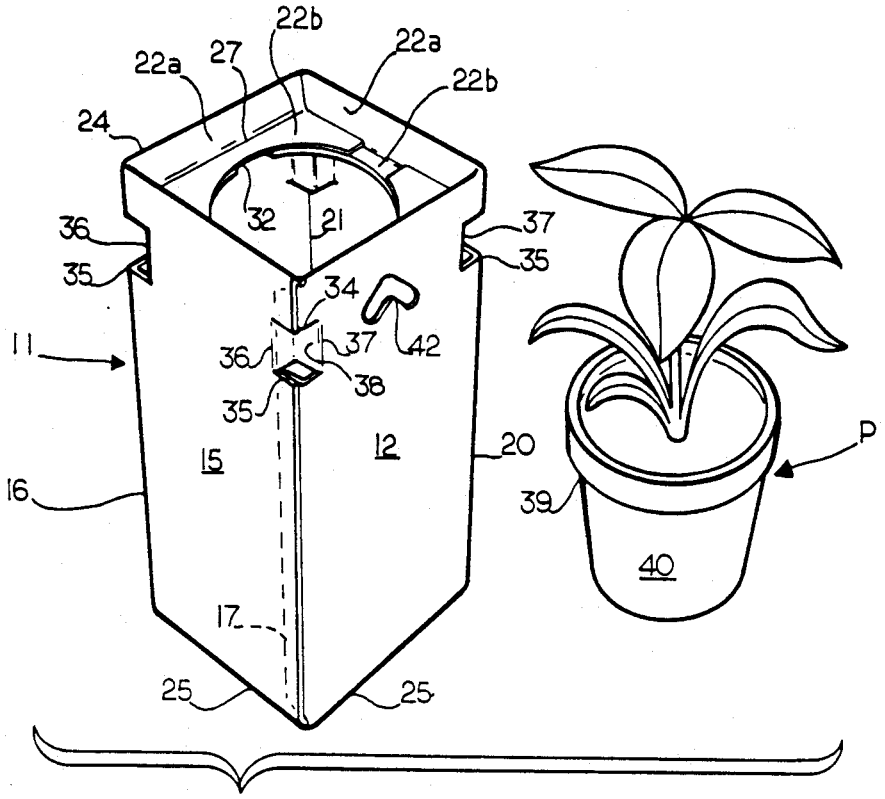
FIG. 4 is a perspective view of the carton showing the potted plant removed and the carton set up for display of the potted plant.

The carton is converted from a shipping container, as shown on FIG. 3, to a display pedestal shown on FIG. 4. Referring to FIG. 1, the blank 10 has laterally extending first slits 34 which are located inwardly on each side panel 12–15 below the first fold line 24 for the top flaps 22 by a distance that is approximately that of the distance between the first score line 24 and the second score line 27. Second slits 35 are spaced below and are parallel to the slits 34. The spaced apart slits 34 and 35 are of the same length laterally in the side panels and are bisected by a fold line at each of the fold lines 18, 16, 19 and 20 for side panels 12–15. Crush style scores 36 and 37 are made at the opposite ends of the first and second slits 34 and 35 connecting the two as hinges located at the opposite ends of the slits. As is seen on FIG. 4, the material of the side panels are pushed inwardly at the corners 18, 16, 19 and 20 of the carton 11 to reverse the attitude of the corrugated paperboard disposed between slits 34 and 35 and form a "pop-in" segment 38 of the respective side panels at the corners of the carton 11. The top flaps 22 when folded inwardly on fold line 24 and reverse folded on fold line 27 are in a position to rest on the edge formed by first slit 34 after pop-in segments 38 of the side panels are pushed inwardly of the carton. By reversing these segments 38 at the corners of the sidewalls they form corner brackets to engage and support the top flaps and reinforce the support of the potted plant. In this fashion, the top flaps are supported and reinforced at the corners of the carton.

Figure 5:
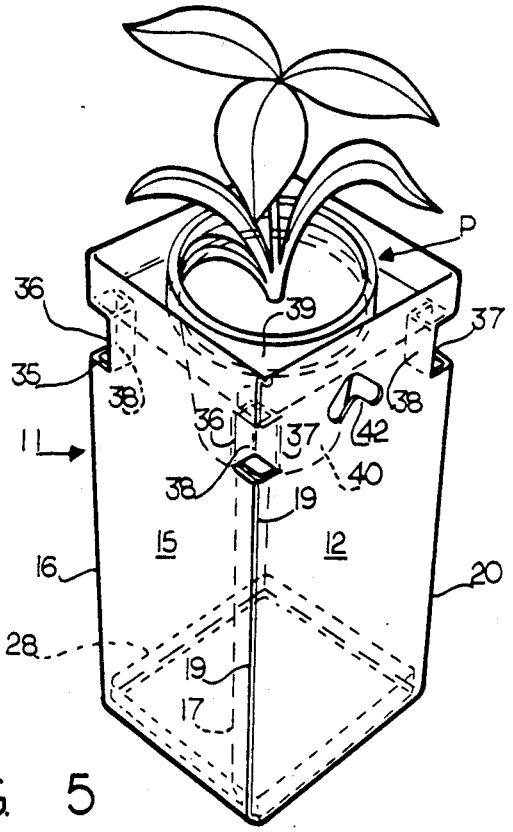
FIG. 5 is a perspective view of the carton of FIG. 4 showing the potted plant supported by the carton on display.

With the parts in the position shown on FIG. 4, potted plant P is lifted onto the top closure of the carton to be supported in the manner shown on FIG. 5. The conventional flower pot P holding the potted plant P has an upper flange wall 39 and below that is an inwardly tapered wall 40. The circular rim edge 32 formed by the removal of the material of the top flaps outlined at perforated arcuate scores 30 is of a diameter less than the diameter of the pot flange 39 so as to support potted plant P in a display fashion shown on FIG. 5. It is preferred that the width dimension (or depth) of the portion 22a of top flaps 22 be equal to or exceed the width of flange 39 of the flower pot. This will display the potted plant P in such a way that the flower pot will not appear above the top edge of carton 11.

The weight of a potted plant may be extreme. In the present invention, the flower or plant is displayed with the pot adequately supported while also allowing it not to be seen within the display; and, therefore, showing only the more attractive flowers. The "pop-in" segments of the carton side walls at the corners of the carton provide adequate reinforcement for supporting this weight by the top flaps. The amount of in-fold of the top flaps provided by the dimension of the first portion 22a of these flaps may be included in the design of the carton for various flower pots to achieve the effect of hiding the pot inside the display. The carton is of dimensions that are currently used in the industry for transporting potted flowers and plants. The carton that is provided according to the invention is strong enough to withstand the extreme shipping conditions, such as vibration, humidity, compression, and the like. And, upon arrival at the retail store, the carton is converted into a visually appealing store display for the contents.

Additionally, die cut hand holes 41 and 42 are provided in opposite side panels of the carton blank, such as side panels 12 and 14. Preferably, hand holes 41 and 42 are located in the upper end region of the carton, but at a level that is below the first slit 34 of the "pop-in" segments at the corners of the side walls. The style of hand hole 41 and 42 that is shown is a V-shaped cutout selected for strength and convenience of the user. Hand holes 41 and 42 are convenient for use in lifting the loaded carton in transport (FIG. 3) and also for lifting the carton and plant for moving them while on display (FIG. 5).

A preferred embodiment of the present invention has been shown and described herein, and it will be appreciated that other embodiments, modifications and variants are possible, and all such apparent embodiments, modifications and variants are to be regarded as being within the spirit and scope of the present invention, as defined by the appended claims.

What is claimed is:

1. A carton for shipment of a floral item in a pot, the pot having a larger diameter top end section, a lesser diameter bottom section, and a circular rim at a juncture between the top end section and the bottom section, said carton comprising plural side panels hingedly connected at fold lines and forming a tubular body having plural corners, bottom flaps hingedly connected at one end of said side panels and closing the bottom end of the tubular body, top flaps each hingedly connected at a first fold line to one of said side panels at their other end opposite said bottom flaps, said top flaps including a second fold line defining a first portion adjacent the side panels and a second portion, said first portion being folded inwardly to lie along said side panel and said second portion being folded normal to said side panel and partly closing the top end of the tubular body, an arcuate perforate score in each of said top flaps defining arcuate portions which together define a circular cutout area in the top end of the tubular body, said circular cutout area upon separation from the top flaps defining a circular rim dimensioned to permit insertion of the bottom section of a flower pot through the aperture to support the flower pot at the circular rim.

2. The carton of claim 1 in which the top flaps, when closing the top end of the tubular body and before separation of the circular cutout area, overlap to provide a vent opening in the top end of the tubular body.

3. The carton of claim 1 wherein the carton is formed form a blank of corrugated paperboard, and further comprising a waterproof covering at the bottom of the carton.

4. The carton of claim 1 wherein the plural side panels consists of four side panels, and wherein each of said four side panels is rectangular and of substantially the same dimensions.

5. The carton of claim 1 and further comprising an integral pop-in bracket at each corner of the carton, each said pop-in bracket being comprised of transverse, parallel, spaced apart slits each extending across the fold line connecting two adjacent side panels and two vertical hinges between said spaced apart slits at the opposite ends of the said spaced apart slits, the pop-in brackets being located at the lower edge of said first portion of the top flaps when they are folded inwardly to lie along the side panels.

6. A carton blank of corrugated paperboard for formation into a carton adapted to receive and transport a potted floral item and to display the floral item, said blank comprising four equal size side panels interconnected along spaced longitudinal fold lines, a securing flap associated with one of said panels adapted to secure said panels into a tubular configuration, a bottom flap interconnected to the bottom end of each of said panels along a transverse fold line, a top flap interconnected to the top end of each of said panels along a first transverse fold line, a second transverse fold line in each said top flap parallel to said first fold line and spaced therefrom each said second transverse fold line dividing each said top flap into first and second portions, each said second portion having an arcuate perforation defining a portion of a circular portion oat a free edge of each said second portion, each said top flap being adapted to be double reverse folded, and each said portion of a circular portion being adapted for easy removal from each said top flap to form a circular portion with the portions of a circular portion of the others of the top flaps, whereby the removal of the portion of a circular portion of each said top flap will form a circular rim support that is recessed from the top end of the carton when formed and said top flaps are then reverse folded, said circular rim support adapted to receive and support a rim of a potted floral item for display.

7. The carton blank of claim 6 and further comprising a pair of parallel transverse slits in adjacent side panels, said slits traversing the fold line between said panels, and a pair of spaced parallel longitudinal score lines in said adjacent side panels extending between said pair of slits, the paperboard outlined by said slits and said longitudinal score lines being adapted to be folded inwardly from said longitudinal fold lines when the said panels are in tubular configuration to provide integral support bracket means along said panels, said support bracket means being placed in said side panels to engage and support the second portion of one or more of said top flaps in reverse folded configuration.

8. The carton blank of claim 7 and further comprising radial perforate tear lines in said second portion of each of the top flaps extending from the edge of said second portion opposite said second fold line to said arcuate perforation.

9. The carton blank of claim 7 and further comprising hand holes in alternate ones of said four side panels for lifting said carton.

10. The carton blank of claim 7 wherein said securing flap is connected to one of said panels along a longitudinal fold line and said securing flap is adapted to be attached to another of the side panels.

11. The carton blank of claim 13 wherein the integral support bracket means comprises a plurality of spaced apart support brackets, and wherein each support bracket extends across one of the longitudinal fold lines connecting an adjacent pair of the side panels.

12. The carton blank of claim 6 and further comprising a waterproof coating layer on the area of the inwardly facing surface of the bottom flaps when the side panels are placed in tubular configuration.

13. The carton blank of claim 12 and further comprising a waterproof coating layer over a portion of the side panels adjacent said bottom flaps.

* * * * *